US011276411B2

(12) United States Patent
Eksler

(10) Patent No.: US 11,276,411 B2
(45) **Date of Patent: *Mar. 15, 2022**

(54) METHOD AND DEVICE FOR ALLOCATING A BIT-BUDGET BETWEEN SUB-FRAMES IN A CELP CODEC

(71) Applicant: VOICEAGE CORPORATION, Town of Mount Royal (CA)

(72) Inventor: Vaclav Eksler, Sherbrooke (CA)

(73) Assignee: VOICEAGE CORPORATION, Town of Mount Royal (CA)

( * ) Notice: Subject to any disclaimer, the term of this patent is extended or adjusted under 35 U.S.C. 154(b) by 12 days.

This patent is subject to a terminal disclaimer.

(21) Appl. No.: 16/647,801

(22) PCT Filed: Sep. 20, 2018

(86) PCT No.: PCT/CA2018/051175

§ 371 (c)(1),
(2) Date: Mar. 16, 2020

(87) PCT Pub. No.: WO2019/056107

PCT Pub. Date: Mar. 28, 2019

(65) Prior Publication Data

US 2020/0243100 A1 Jul. 30, 2020

Related U.S. Application Data

(60) Provisional application No. 62/560,724, filed on Sep. 20, 2017.

(51) Int. Cl.
*G10L 19/12* (2013.01)
*G10L 19/24* (2013.01)
(Continued)

(52) U.S. Cl.
CPC ..... *G10L 19/12* (2013.01); *G10L 19/002* (2013.01); *G10L 19/038* (2013.01); *G10L 19/24* (2013.01)

(58) Field of Classification Search
CPC ..... G10L 19/12; G10L 19/002; G10L 19/038; G10L 19/24
See application file for complete search history.

(56) References Cited

U.S. PATENT DOCUMENTS 6,898,566 B1 5/2005 Benyassine et al.
8,825,475 B2 9/2014 Eksler
(Continued)

FOREIGN PATENT DOCUMENTS

EP 2302624 3/2011
EP 2255358 7/2013
(Continued)

OTHER PUBLICATIONS

Lei Miao et al., "G.711.1 Annex D and G.722 Annex B—New ITU-T Superwideband Codecs", 2011 IEEE International Conference on Acoustics, Speech and Signal Processing: (ICASSP 2011); Prague, Czech Republic, May 22-27, 2011 (May 22, 2011), pp. 5232-5235, XP032001862, DOI: 10.1109/ICASSP.2011.5947537; ISBN:978-1-4577-0538-0; *Section 3.2*.
(Continued)

*Primary Examiner* — Bryan S Blankenagel
(74) *Attorney, Agent, or Firm* — Fay Kaplun & Marcin, LLP

(57) ABSTRACT

A method and device for allocating a bit-budget to a plurality of first parts and to a second part of a CELP core module of (a) an encoder for encoding a sound signal or (b) a decoder for decoding the sound signal. In a frame of the sound signal comprising sub-frames, respective bit-budgets are allocated to the first CELP core module parts and a bit-budget
(Continued)

remaining after allocating to the first CELP core module parts their respective bit-budgets is allocated to the second CELP core module part. According to an alternative, the second CELP core module part bit-budget is distributed between the sub-frames of the frame and a larger bit-budget is allocated to at least one of the sub-frames of the frame. The at least one sub-frame may be the first sub-frame of the frame, at least one sub-frame following the first sub-frame, or the sub-frame using a glottal-impulse-shape codebook.

40 Claims, 3 Drawing Sheets

(51) Int. Cl.
*G10L 19/002* (2013.01)
*G10L 19/038* (2013.01)

(56) References Cited

U.S. PATENT DOCUMENTS 8,965,775 B2 2/2015 Virette et al.
9,053,705 B2 6/2015 Bessette
9,626,973 B2 4/2017 Taleb et al.
2005/0177364 A1 8/2005 Jelinek
2007/0124139 A1 5/2007 Chen
2008/0294429 A1* 11/2008 Su ..... G10L 19/18 704/222
2009/0306992 A1 12/2009 Ragot et al.
2010/0241425 A1* 9/2010 Eksler ..... G10L 19/12 704/220
2012/0029925 A1* 2/2012 Duni ..... G10L 25/90 704/500
2012/0185255 A1* 7/2012 Virette ..... G10L 19/24 704/500
2012/0290295 A1* 11/2012 Eksler ..... G10L 19/22 704/219
2013/0121508 A1 5/2013 Vaillancourt et al.
2014/0025375 A1* 1/2014 Norvell ..... G10L 19/0212 704/225
2014/0068097 A1* 3/2014 Redelinghuys .. H04N 21/44209 709/231
2014/0163973 A1 6/2014 Vos
2015/0106106 A1* 4/2015 Atti ..... G10L 19/002 704/500
2015/0131800 A1* 5/2015 Mundt ..... G10L 19/032 381/22
2018/0182408 A1* 6/2018 Ragot ..... G10L 19/12

FOREIGN PATENT DOCUMENTS

RU 2485606 7/2012
RU 2547238 4/2015
RU 2591021 7/2016
RU 2596584 9/2016
WO 2001/022402 3/2001
WO 2005/078706 8/2005
WO 2006/091139 8/2006
WO 2016/016566 2/2016
WO 2017/049397 3/2017
WO 2017/049400 3/2017

OTHER PUBLICATIONS

Baumgarte et al., "Binaural cue coding—Part I: Psychoacoustic fundamentals and design principles," IEEE Trans. Speech Audio Processing, vol. 11, No. 6, Nov. 2003, pp. 509-519.
Eksler et al., "Glottal-Shape Codebook to Improve Robustness of CELP Codecs", IEEE Trasactions on Audio, Speech and Language Processing, vol. 18, No. 6, Aug. 2010, pp. 1208-1217.
ITU-T Recommendation G.718, "Frame error robust narrowband and wideband embedded variable bit-rate coding of speech and audio from 8-32kbps", Jun. 2008, 259 sheets.
3GPP Spec. TS 26.445, "EVS Codec Detailed Algorithmic Description," v.12.0.0, Nov. 2014, 627 sheets.
3GPP Spec. TS 26.445, "Codec for Enhance Voice Services (EVS) Codec Detailed Algorithmic Description," v.14.1.0, Aug. 2017, 660 sheets.

* cited by examiner

METHOD AND DEVICE FOR ALLOCATING A BIT-BUDGET BETWEEN SUB-FRAMES IN A CELP CODEC

TECHNICAL FIELD

The present disclosure relates to a technique for digitally encoding a sound signal, for example a speech or audio signal, in view of transmitting or storing, and synthesizing this sound signal. An encoder converts the sound signal into a digital bit-stream using a bit-budget. A decoder or synthesizer then operates on the transmitted or stored bit-stream and converts it back to the sound signal. The encoder and decoder/synthesizer are commonly known as a codec.

More specifically, but not exclusively, the present disclosure relates a method and device for efficiently distributing the bit-budget in a codec.

BACKGROUND

One of the best techniques for encoding sound at low bit rates is the Code-Excited Linear Prediction (CELP) coding. In CELP coding, the sound signal is sampled and the sampled sound signal is processed in successive blocks of L samples usually called frames, where L is a predetermined number corresponding typically to 20 ms. The main principle behind CELP is called "Analysis-by-Synthesis" where possible decoder outputs are synthesized during the encoding process and then compared to the original sound signal. This search minimizes a mean-squared error between the input sound signal and the synthesized sound signal in a perceptually weighted domain.

In CELP-based coding, the sound signal is typically synthesized by filtering an excitation through an all-pole digital filter $1/A(z)$, often called synthesis filter. Filter $A(z)$ is estimated by means of Linear Prediction (LP) and represents short-term correlations between sound signal samples. The LP filter coefficients are usually calculated once per frame. In CELP codecs, the frame is further divided into several (usually two (2) to five (5)) sub-frames to encode the excitation that is typically composed of two portions searched sequentially. Their respective gains may then be jointly quantized. In the following description, the number of sub-frames is denoted as N and the index of a particular sub-frame is denoted as n where $n=0, \ldots, N-1$.

The first portion of the excitation is usually selected from an adaptive codebook. The adaptive codebook excitation portion exploits the quasi periodicity (or long-term correlations) of voiced speech signal by searching in the past excitation the segment most similar to the segment being currently encoded. The adaptive codebook excitation portion is described by an adaptive codebook index, i.e. a delay parameter corresponding to a pitch period, and an appropriate adaptive codebook gain, both sent to the decoder or stored to reconstruct the same excitation as in the encoder.

The second portion of the excitation is usually an innovation signal selected from an innovation codebook. The innovation signal models the evolution (difference) between the previous speech segment and the currently encoded segment. The second portion of the excitation is described by an index of a codevector selected from the innovation codebook, and by an innovation codebook gain (this is also referred to as fixed codebook index and fixed codebook gain).

In order to improve the coding efficiency, recent codecs such as, for example, G.718 as described in Reference [1] and EVS as described in Reference [2], are based on classification of the input sound signal. Based on the signal characteristics, basic CELP coding is expanded into several different coding modes. Consequently, the classification needs to be transmitted to the decoder or stored as a signaling information. Another signaling information that is usually efficient to transmit is, for example, an audio bandwidth information.

Thus, in a CELP codec, so-called CELP "core module" parts may include:

The LP filter coefficients;

The adaptive codebook;

The innovation (fixed) codebook; and

The adaptive and innovation codebook gains.

Most recent CELP codecs are based on a constant bit rate (CBR) principle. In CBR codecs a bit-budget to encode a given frame is constant during the encoding, regardless of the sound signal content or network characteristics. In order to obtain the best possible quality at a given constant bit rate, the bit-budget is carefully distributed among the different coding parts. In practice, the bit-budget per coding part at a given bit rate is usually fixed and stored in codec ROM tables. However, when the number of bit rates supported by a codec increases, the length of the ROM tables proportionally increases and the search within these tables becomes less efficient.

The problem of large ROM tables is even more significant in complex codecs where the bit-budget allocated to the CELP core module might fluctuate even at codec constant bit rate. For example, in a complex multi-module codec where the bit-budget at a constant bit rate is allocated between different modules based on, for example, a number of input audio channels, network feedback, audio bandwidth, input signal characteristics, etc., the codec total bit-budget is distributed among the CELP core module and other different modules. Examples of such other different modules may comprise, but are not limited to, a bandwidth extension (BWE), a stereo module, a frame error concealment (FEC) module etc. which are collectively referred to in the present description as "supplementary codec modules". It is usually advantageous to keep the allocated bit-budget per supplementary module variable based on signal characteristics or network feedback. Also, the supplementary codec modules can be adaptively switched on and off. This variability usually does not cause problems for encoding supplementary modules as the number of parameters in these modules is usually small. However, the fluctuating bit-budget allocated to supplementary codec modules results in a fluctuating bit-budget allocated to the relatively complex CELP core module.

In practice, the bit-budget allocated to the CELP core module at a given bit rate is usually obtained by reducing the codec total bit-budget with the bit-budget allocated to all active supplementary codec modules which may include a codec signaling bit-budget. Consequently, the bit-budget allocated to the CELP core module can fluctuate between a relatively large minimum and maximum bit rate span with a granularity as small as 1 bit (i.e. 0.05 kbps at a frame length of 20 ms).

Dedicating ROM table entries for all possible CELP core module bit rates is obviously inefficient. Therefore, there is a need for a more efficient and flexible distribution of the bit-budget among the different modules with fine bit rate granularity based on a limited number of intermediate bit rates.

SUMMARY

According to a first aspect, the present disclosure is concerned with a method of allocating a bit-budget to a plurality of first parts and to a second part of a CELP core module of (a) an encoder for encoding a sound signal or (b) a decoder for decoding the sound signal, comprising in a frame of the sound signal comprising sub-frames: allocating to the first CELP core module parts respective bit-budgets; and allocating to the second CELP core module part a bit-budget remaining after allocating to the first CELP core module parts the respective bit-budgets. Allocating the second CELP core module part bit-budget comprises distributing the second CELP core module part bit-budget between the sub-frames of the frame and allocating a larger bit-budget to at least one of the sub-frames of the frame.

According to a second aspect, there is provided a device for allocating a bit-budget to a plurality of first parts and to a second part of a CELP core module of (a) an encoder for encoding a sound signal or (b) a decoder for decoding the sound signal, comprising for a frame of the sound signal comprising sub-frames: a first allocator of respective bit-budgets to the first CELP core module parts; and a second allocator, to the second CELP core module part, of a bit-budget remaining after allocating to the first CELP core module parts the respective bit-budgets. The second allocator distributes the second CELP core module part bit-budget between the sub-frames of the frame and allocates a larger bit-budget to at least one of the sub-frames of the frame.

According to a third aspect, there is provided a method of allocating a bit-budget to a plurality of first parts and a second part of a CELP core module of an encoder for encoding a sound signal, comprising: storing bit-budget allocation tables assigning, for each of a plurality of intermediate bit rates, respective bit-budgets to the first CELP core module parts; determining a CELP core module bit rate; selecting one of the intermediate bit rates based on the determined CELP core module bit rate; allocating to the first CELP core module parts the respective bit-budgets assigned by the bit-budget allocation tables for the selected intermediate bit rate; and allocating to the second CELP core module part a bit-budget remaining after allocating to the first CELP core module parts the respective bit-budgets assigned by the bit-budget allocation tables for the selected intermediate bit rate. The CELP core module uses, in one sub-frame of a frame of the sound signal, a glottal-impulse-shape codebook, and allocating the second CELP core module part bit-budget comprises distributing the second CELP core module part bit-budget between the sub-frames of the frame and allocating a highest bit-budget to the sub-frame comprising the glottal-impulse-shape codebook.

A further aspect is concerned with a device for allocating a bit-budget to a plurality of first parts and a second part of a CELP core module of (a) an encoder for encoding a sound signal or (b) a decoder for decoding the sound signal, comprising: bit-budget allocation tables assigning, for each of a plurality of intermediate bit rates, respective bit-budgets to the first CELP core module parts; a calculator of a CELP core module bit rate; a selector of one of the intermediate bit rates based on the determined CELP core module bit rate; a first allocator of the respective bit-budgets assigned by the bit-budget allocation tables, for the selected intermediate bit rate, to the first CELP core module parts; and a second allocator, to the second CELP core module part, of a bit-budget remaining after allocating to the first CELP core module parts the respective bit-budgets assigned by the bit-budget allocation tables for the selected intermediate bit rate. The CELP core module uses, in one sub-frame of a frame of the sound signal, a glottal-impulse-shape codebook, and the second allocator distributes the second CELP core module part bit-budget between the sub-frames of the frame and allocates a highest bit-budget to the sub-frame comprising the glottal-impulse-shape codebook.

The foregoing and other objects, advantages and features of the bit-budget allocating method and device will become more apparent upon reading of the following non-restrictive description of illustrative embodiments thereof, given by way of example only with reference to the accompanying drawings.

DETAILED DESCRIPTION

Figure 1:
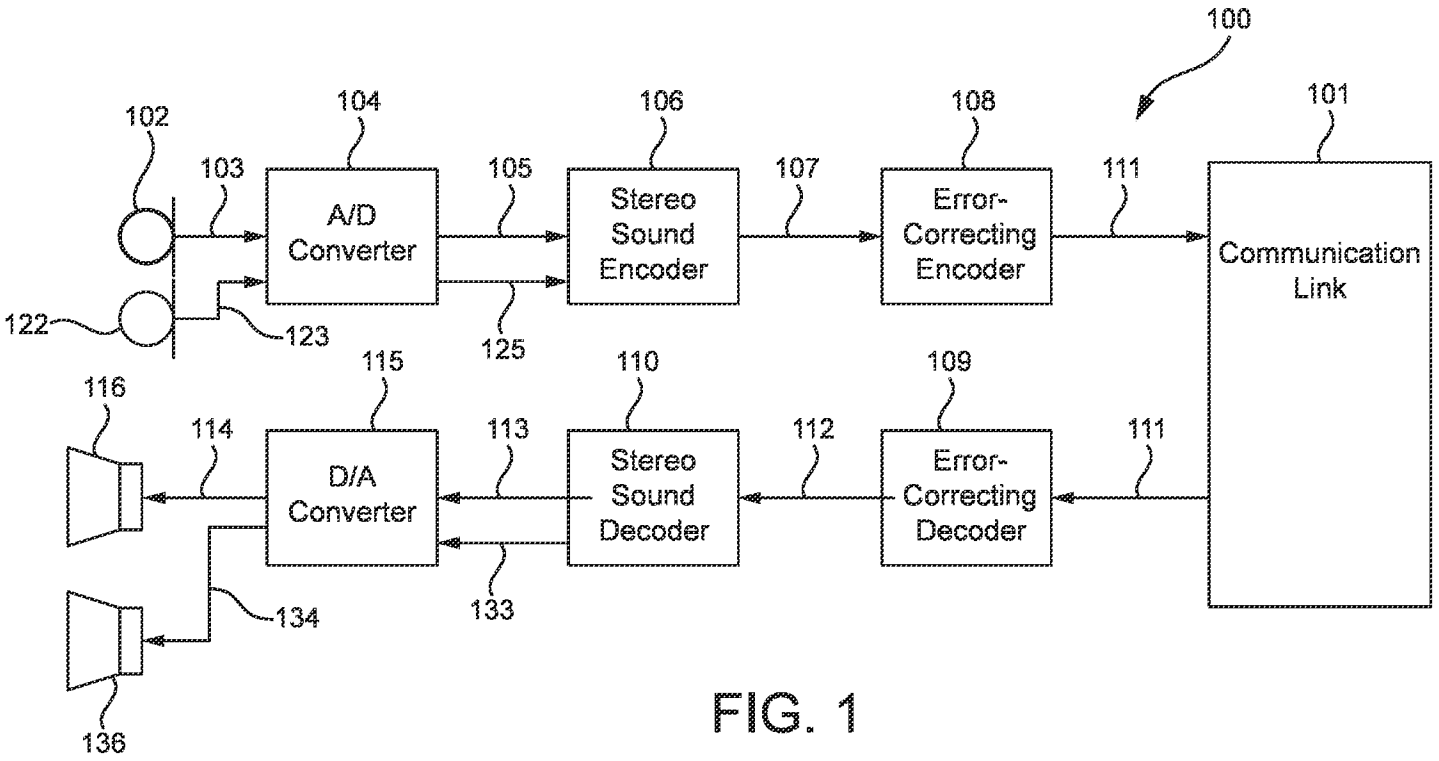
FIG. 1 is a schematic block diagram of a stereo sound processing and communication system depicting a possible context of implementation of the bit-budget allocating method and device as disclosed in the following description.

FIG. 1 is a schematic block diagram of a stereo sound processing and communication system 100 depicting a possible context of implementation of the bit-budget allocating method and device as disclosed in the following description. It should be noted that the presented bit-budget allocating method and device are not limited to stereo, but can be used also in multi-channel coding or mono coding.

The stereo sound processing and communication system 100 of FIG. 1 supports transmission of a stereo sound signal across a communication link 101. The communication link 101 may comprise, for example, a wire or an optical fiber link. Alternatively, the communication link 101 may comprise at least in part a radio frequency link. The radio frequency link often supports multiple, simultaneous communications requiring shared bandwidth resources such as may be found with cellular telephony. Although not shown, the communication link 101 may be replaced by a storage device in a single device implementation of the processing and communication system 100 that records and stores the encoded stereo sound signal for later playback.

Still referring to FIG. 1, for example a pair of microphones 102 and 122 produces the left 103 and right 123 channels of an original analog stereo sound signal detected. As indicated in the foregoing description, the sound signal may comprise, in particular but not exclusively, speech and/or audio.

The left 103 and right 123 channels of the original analog sound signal are supplied to an analog-to-digital (A/D) converter 104 for converting them into left 105 and right 125 channels of an original digital stereo sound signal. The left 105 and right 125 channels of the original digital stereo sound signal may also be recorded and supplied from a storage device (not shown).

A stereo sound encoder 106 encodes the left 105 and right 125 channels of the digital stereo sound signal thereby producing a set of encoding parameters that are multiplexed under the form of a bit-stream 107 delivered to an optional error-correcting encoder 108. The optional error-correcting encoder 108, when present, adds redundancy to the binary representation of the encoding parameters in the bit-stream 107 before transmitting the resulting bit-stream 111 over the communication link 101.

On the receiver side, an optional error-correcting decoder 109 utilizes the above mentioned redundant information in the received digital bit-stream 111 to detect and correct errors that may have occurred during transmission over the communication link 101, producing a bit-stream 112 with received encoding parameters. A stereo sound decoder 110 converts the received encoding parameters in the bit-stream 112 for creating synthesized left 113 and right 133 channels of the digital stereo sound signal. The left 113 and right 133 channels of the digital stereo sound signal reconstructed in the stereo sound decoder 110 are converted to synthesized left 114 and right 134 channels of the analog stereo sound signal in a digital-to-analog (D/A) converter 115.

The synthesized left 114 and right 134 channels of the analog stereo sound signal are respectively played back in a pair of loudspeaker units 116 and 136 (the pair of loudspeaker units 116 and 136 can obviously be replaced by a headphone). Alternatively, the left 113 and right 133 channels of the digital stereo sound signal from the stereo sound decoder 110 may also be supplied to and recorded in a storage device (not shown).

As a non-limitative example, the bit-budget allocating method and device according to the present disclosure can be implemented in the sound encoder 106 and decoder 110 of FIG. 1. It should be noted that FIG. 1 can be extended to cover the case of multi-channel and/or scene-based audio and/or independent streams encoding and decoding (e.g. surround and high order ambisonics).

Figure 2:
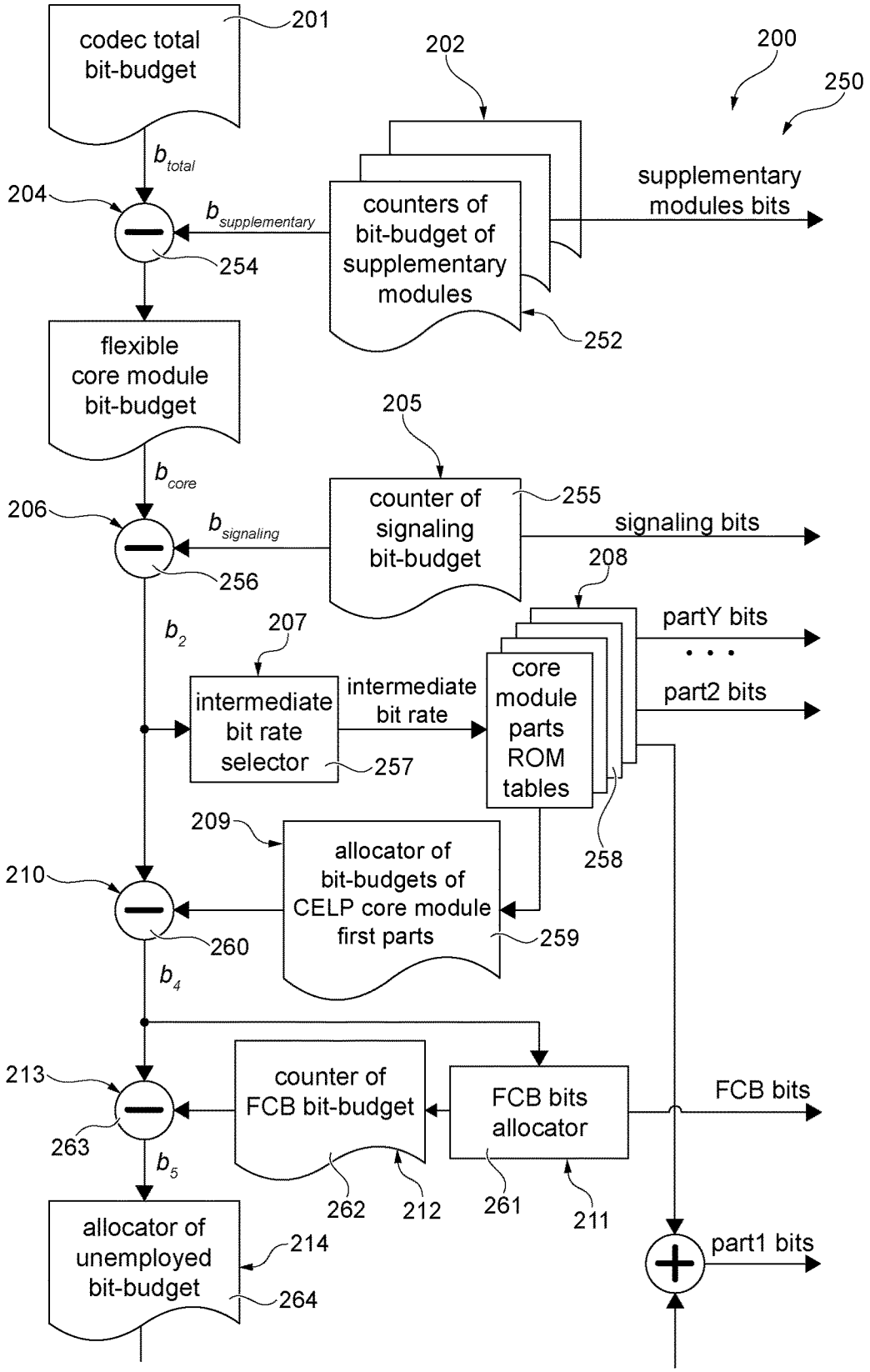
FIG. 2 is a block diagram illustrating concurrently a bit-budget allocating method and device of the present disclosure.

FIG. 2 is a block diagram illustrating concurrently the bit-budget allocating method 200 and device 250 according to the present disclosure.

Here, it should be noted that the bit-budget allocating method 200 and device 250 operate on a frame by frame basis and the following description is related to one of the successive frames of the sound signal being encoded, unless otherwise stated.

In FIG. 2, CELP core module encoding whose bit-budget fluctuates from frame to frame as a result of a fluctuating number of bits used for encoding the supplementary codec modules is considered. Also, the distribution of bit-budget among the different CELP core module parts is symmetrically done at the encoder 106 and the decoder 110 and is based on the bit-budget allocated to encoding of the CELP core module.

The following description presents a non-restrictive example of implementation in an EVS-based codec using the Generic Coding mode. The EVS-based codec is a codec based on the EVS standard as described in Reference [2], with modifications to permit other CELP-core bit rates or codec improvements. The EVS-based codec in this disclosure is used within a coding framework using supplementary coding modules such as metadata, stereo or multi-channel coding (this is referred to hereinafter as Extended EVS codec). Principles similar to those as described in the present disclosure can be applied to other coding modes (e.g. Voiced Coding, Transition Coding, Inactive Coding, . . . ) within the EVS-based codec. Moreover, similar principles can be implemented in any other codec different from EVS and using a coding scheme other than CELP.

Operation 201

Referring to FIG. 2, a total bit-budget $b_{total}$ is allocated to the codec for each successive frame of the sound signal. In case of CBR, this codec total bit-budget $b_{total}$ is constant. It is also possible to use the bit-budget allocating method 200 and device 250 in variable bit rate codecs wherein the codec total bit-budget $b_{total}$ could vary from frame to frame (as in the case with the extended EVS codec).

Operations 202

In operations 202, counters 252 determine (count) the number of bits (bit-budget) $b_{supplementary}$ used for encoding the supplementary codec modules and the number of bits (bit-budget) $b_{codec_signaling}$ (not shown) for transmitting codec signaling to the decoder.

Supplementary codec modules may comprise a stereo module, a Frame-Erasure concealment (FEC) module, a BandWidth Extension (BWE) module, metadata coding module, etc. In the following illustrative embodiment, the supplementary modules comprise a stereo module and a BWE module. Of course, different or additional supplementary codec modules could be used.

Stereo Module

A codec may be designed to support encoding of more than one input audio channel. In case of two audio channels, a mono (single channel) codec may be extended by a stereo module to form a stereo codec. The stereo module then forms one of the supplementary codec modules. A stereo codec can be implemented using several different stereo encoding techniques. As non-limitative examples, the use of two stereo encoding techniques that can be efficiently used at low bit rates is discussed hereinafter. Obviously, other stereo encoding techniques can be implemented.

A first stereo encoding technique is called parametric stereo. Parametric stereo encodes two audio channels as a mono signal using a common mono codec plus a certain amount of stereo side information (corresponding to stereo parameters) which represents a stereo image. The two input audio channels are down-mixed into a mono signal, and the stereo parameters are then computed usually in transform domain, for example in the Discrete Fourier Transform (DFT) domain, and are related to so-called binaural or interchannel cues. The binaural cues (See Reference [5]) comprise Interaural Level Difference (ILD), Interaural Time Difference (ITD) and Interaural Correlation (IC). Depending on the signal characteristics, stereo scene configuration, etc., some or all binaural cues are encoded and transmitted to the decoder. Information about what cues are encoded is sent as signaling information, which is usually part of the stereo side information. A particular binaural cue can be also quantized using different encoding techniques which results in a variable number of bits being used. Then, in addition to the quantized binaural cues, the stereo side information may contain, usually at medium and higher bit rates, a quantized residual signal that results from the down-mixing. The residual signal can be encoded using an entropy encoding technique, e.g. an arithmetic encoder. Consequently, the number of bits used for encoding the residual signal can fluctuate significantly from frame to frame.

Another stereo encoding technique is a technique operating in time-domain. This stereo encoding technique mixes the two input audio channels into so-called primary channel and secondary channel. For example, following the method described in Reference [6], time-domain mixing can be based on a mixing factor, which determines respective contributions of the two input audio channels upon production of the primary channel and the secondary channel. The mixing factor is derived from several metrics, e.g. normalized correlations of the input channels with respect to a mono signal or a long-term correlation difference between the two input channels. The primary channel can be encoded by a common mono codec while the secondary channel can be encoded by a lower bit rate codec. The secondary channel encoding may exploit coherence between the primary and secondary channels and might reuse some parameters from the primary channel. Consequently, the number of bits used for encoding the primary channel and the secondary channel can fluctuate significantly from frame to frame based on channel similarities and encoding modes of the respective channels.

Stereo encoding techniques are otherwise known to those of ordinary skill in the art and, therefore, will not be further described in the present specification. Although stereo was described as a way of example of supplementary coding modules, the disclosed method can be used in a 3D audio coding framework including ambisonics (scene-based audio), multichannel (channel-based audio), or objects plus metadata (object-based audio). Supplementary modules may also comprise any of these techniques.

BWE Module

In most of the recent speech codecs, including wideband (WB) or super wideband (SWB) codecs, the input signal is processed in blocks (frames) while employing frequency band-split processing. A lower frequency band is usually encoded using the CELP model and covers frequencies up to a cut-off frequency. Then the higher frequency band is efficiently encoded or estimated separately by a BWE technique in order to cover the rest of the encoded spectrum. The cut-off frequency between the two bands is a design parameter of each codec. For example, in the EVS codec as described in Reference [2], the cut-off frequency depends upon the operational mode and bit rate of the codec. In particular, the lower frequency band extends up to 6.4 kHz at bit rates of 7.2-13.2 kbps or up to 8 kHz at bit rates of 16.4-64 kbps. A BWE then further extends the audio bandwidth for WB (up to 8 kHz), SWB (Up to 14.4 or 16 kHz), or Full Band (FB, up to 20 kHz) encoding.

The idea behind BWE is to exploit the intrinsic correlation between the lower and higher frequency bands and make benefit of the higher perceptual tolerance to encoding distortions in higher frequencies compared to lower frequencies. Consequently, the number of bits used for the higher band BWE encoding is usually very low compared to the lower band CELP encoding, or even zero. For example, in the EVS codec as described in Reference [2], a BWE where no bit-budget is transmitted (a so-called blind BWE) is used at bit rates of 7.2-8.0 kbps while a BWE with some bit-budget (a so-called guided BWE) is used at bit rates of 9.6-64 kbps. The exact bit-budget of a guided BWE is dependent on the actual codec bit rate.

In the following description guided BWE is considered, which forms one of the supplementary codec modules. The number of bits used for the higher band BWE encoding can fluctuate from frame to frame and is much lower (typically 1-3 kbps) than the number of bits used for the lower band CELP encoding.

Again, BWE is otherwise known to those of ordinary skill in the art and, therefore, will not be further described in the present specification.

Codec Signaling

The bit-stream, usually at its beginning, contains codec signaling bits. These bits (codec signaling bit-budget) usually represent very high level codec parameters, for example codec configuration or information about the nature of the supplementary codec modules that are encoded. In case of a multi-channel codec, these bits can represent for example a number of encoded (transport) channels and/or codec format (scene based or object based, etc.). In case of stereo encoding, these bits can represent for example the stereo encoding technique being used. Another example of codec parameter that can be sent using codec signaling bits is an audio signal bandwidth.

Again, codec signaling is otherwise known to those of ordinary skill in the art and, therefore, will not be further described in the present specification. Also, a counter (not shown) can be used for counting the number of bits (bit-budget) used for codec signaling.

Operation 204

Referring back to FIG. 2, in operation 204, a subtractor 254 subtracts the bit-budget $b_{supplementary}$ for encoding of the supplementary codec modules and the bit-budget $b_{codec_signaling}$ for transmitting codec signaling, from the codec total bit-budget $b_{total}$ to obtain a bit-budget $b_{core}$ of the CELP core module, using the following relation:

$$b_{core}=b_{total}-b_{supplementary}-b_{codec_signaling} \quad (1)$$

As explained above, the number of bits $b_{supplementary}$ for encoding the supplementary codec modules and the bit-budget $b_{codec_signaling}$ for transmitting codec signaling to the decoder fluctuates from frame to frame and, therefore, the bit-budget $b_{core}$ of the CELP core module also fluctuates from frame to frame.

Operation 205

In operation 205, a counter 255 counts the number of bits (bit-budget) $b_{signaling}$ for transmitting to the decoder CELP core module signaling. CELP core module signaling may comprise, for example, audio bandwidth, CELP encoder type, sharpening flag, etc.

Operation 206

In operation 206, a subtractor 256 subtracts the bit-budget $b_{signaling}$ for transmitting CELP core module signaling from the CELP core module bit-budget $b_{core}$ to find a bit-budget $b_2$ for encoding the CELP core module parts, using the following relation:

$$b_2=b_{core}-b_{signaling} \quad (2)$$

Operation 207

In operation 207, an intermediate bit rate selector 257 comprises a calculator which converts the bit-budget $b_2$ into a CELP core module bit rate by dividing the number of bits $b_2$ by the duration of a frame. The selector 257 finds an intermediate bit rate based on the CELP core module bit rate.

A small number of candidate intermediate bit rates is used. In an example of implementation within the EVS-based codec, the following fifteen (15) bit rates may be considered as candidate intermediate bit rates: 5.00 kbps, 6.15 kbps, 7.20 kbps, 8.00 kbps, 9.60 kbps, 11.60 kbps, 13.20 kbps, 14.80 kbps, 16.40 kbps, 19.40 kbps, 22.60 kbps, 24.40 kbps, 32.00 kbps, 48.00 kbps, and 64.00 kbps. Of course, it is possible to use a number of candidate intermediate bit rates different from fifteen (15) and also to use candidate intermediate bit rates of different values.

In the same example of implementation, within the EVS-based codec, the found intermediate bit rate is the nearest higher candidate intermediate bit rate to the CELP core module bit rate. For example, for a 9.00 kbps CELP core module bit rate the found intermediate bit rate would be 9.60 kbps when using the candidate intermediate bit rates listed in the previous paragraph.

In another example of implementation, the found intermediate bit rate is the nearest lower candidate intermediate bit rate to the CELP core module bit rate. Using the same example, for a 9.00 kbps CELP core module bit rate the found intermediate bit rate would be 8.00 kbps when using the candidate intermediate bit rates listed in the previous paragraph.

Operations 208

In operation 208, ROM tables 258 store, for each candidate intermediate bit rate, respective, pre-determined bit-budgets for encoding first parts of the CELP core module. As a non-limitative example, the CELP core module first parts for which bit-budgets are stored in the ROM tables 258 may comprise the LP filter coefficients, the adaptive codebook, the adaptive codebook gain, and the innovation codebook gain. In this implementation, no bit-budget for encoding the innovation codebook is stored in the ROM tables 258.

In other words, when one of the candidate intermediate bit rates is selected by the selector 257, the associated bit-budgets stored in the ROM tables 258 are allocated to encoding of the above identified CELP core module first parts (the LP filter coefficients, the adaptive codebook, the adaptive codebook gain, and the innovation codebook gain). However, in the described implementation, no bit-budget for encoding the innovation codebook is stored in the ROM tables 258.

The following Table 1 is an example of ROM table 258 storing, for each candidate intermediate bit rate, a respective bit-budget (number of bits) $b_{LPC}$ for encoding the LP filter coefficients. The right column identifies the candidate intermediate bit rates while the left column indicates the respective bit-budgets (number of bits) $b_{LPC}$. For simplicity the bit-budget for encoding the LP filter coefficients is a single value per frame although it could be a sum of several bit-budget values when more than one LP analysis are done in a current frame (for example a mid-frame and an end-frame LP analysis).

TABLE 1

(expressed in pseudocode)

```
const short LSF_bits_tbl[15] =
{
    27,         /* 5k00        */
    28,         /* 6k15        */
    29,         /* 7k20        */
    33,         /* 8k00        */
    35,         /* 9k60        */
    37,         /* 11k60       */
    38,         /* 13k20       */
    39,         /* 14k80       */
    39,         /* 16k40       */
    40,         /* 19k40       */
    41,         /* 22k60       */
    42,         /* 24k40       */
    43,         /* 32k         */
    44,         /* 48k         */
    46,         /* 64k         */
};
```

The following Table 2 is an example of ROM table 258 storing, for each candidate intermediate bit rate, respective bit-budgets (number of bits) $b_{ACBn}$ for encoding the adaptive codebook. The right column identifies the candidate intermediate bit rates while the left column indicates the respective bit-budgets (number of bits) $b_{ACBn}$. As the adaptive codebook is searched in every sub-frame n, N bit-budget $b_{ACBn}$ (one per sub-frame) are obtained for every candidate intermediate bit rate, N representing the number of sub-frames in a frame. It should be noted that the bit-budgets $b_{ACBn}$ may be different in different sub-frames. Specifically, Table 2 is an example of ROM table 258 storing bit-budgets $b_{ACBn}$ in the EVS-based codec using the above defined fifteen (15) candidate intermediate bit rates.

TABLE 2

(expressed in pseudocode)

```
const short ACB_bits_tbl[15] = {
        7,4, 7,4,       /* 5k00        */
        7,5, 7,5,       /* 6k15        */
        8,5, 8,5,       /* 7k20        */
        9,5, 8,5,       /* 8k00        */
        9,6, 9,6,       /* 9k60        */    <--- intermediate bit rate
    10,6, 9,6,          /* 11k60       */
    10,6, 9,6,          /* 13k20       */
    10,6,10,6,          /* 14k80       */
    10,6,10,6,          /* 16k40       */
        9,6, 9,6,6,     /* 19k40       */
    10,6, 9,6,6,        /* 22k60       */
    10,6,10,6,6,        /* 24k40       */
    10,6,10,6,6,        /* 32k         */
    10,6,10,6,6,        /* 48k         */
    10,6,10,6,6,        /* 64k         */
};
```

It should be noted that, in the example using the EVS-based codec, four (4) bit-budgets $b_{ACBn}$ per intermediate bit rate are stored at lower bit rates where the frame of 20 ms is composed of four (4) sub-frames (N=4) and five (5) bit-budgets $b_{ACBn}$ per intermediate bit rate are stored at higher bit rates where the frame of 20 ms is composed of five (5) sub-frames (N=5). Referring to Table 2, for a CELP core module bit rate of 9.00 kbps corresponding to an intermediate bit rate of 9.60 kbps, the bit-budgets $b_{ACBn}$ in the individual sub-frames are 9, 6, 9, and 6 bits, respectively.

The following Table 3 is an example of ROM table 258 storing, for each candidate intermediate bit rate, respective bit-budgets (number of bits) $b_{Gn}$ for encoding the adaptive codebook gain and the innovation codebook gain. In the example below, the adaptive codebook gain and the innovation codebook gain are quantized using a vector quantizer and thus represented as only one quantization index. The right column identifies the candidate intermediate bit rates while the left column indicates the respective bit-budgets (number of bits) $b_{Gn}$. As can be seen from Table 3, there is one bit-budget $b_{Gn}$ for every sub-frame n of a frame. Accordingly, N bit-budgets $b_{Gn}$ are stored for every candidate intermediate bit rate, N representing the number of sub-frames in a frame. It should be noted that, depending on the gain quantizer and size of the quantization table being used, the bit-budgets $b_{Gn}$ may be different in different sub-frames.

TABLE 3

(expressed in pseudocode)

```
const short gain_bits_tbl[15] =
{
    6, 6, 5, 5,         /* 5k00        */
    6, 6, 6, 6,         /* 6k15        */
    7, 6, 6, 6,         /* 7k20        */
    8, 7, 6, 6,         /* 8k00        */
    6, 5, 6, 5,         /* 9k60        */
    6, 6, 6, 6,         /* 11k60       */
    6, 6, 6, 6,         /* 13k20       */
    7, 6, 7, 6,         /* 14k80       */
    7, 7, 7, 7,         /* 16k40       */
    6, 6, 6, 6, 6,      /* 19k40       */
    7, 6, 7, 6, 6,      /* 22k60       */
    7, 7, 7, 7, 7,      /* 24k40       */
    7, 7, 7, 7, 7,      /* 32k         */
    10,10,10,10,10,     /* 48k         */
    12,12,12,12,12,     /* 64k         */
};
```

In the same manner, a bit-budget for quantizing other CELP core module first parts (if they are present) can be stored in the ROM tables 258 for each candidate intermediate bit rate. An example could be a flag of an adaptive codebook low-pass filtering (one bit per sub-frame). Therefore, a bit-budget associated to all CELP core module parts (first parts) except of the innovation codebook can be stored in the ROM tables 258 for each candidate intermediate bit rate while a certain bit-budget $b_4$ still remains available.

Operation 209

In operation 209, a bit-budget allocator 259 allocates for encoding the above mentioned CELP core module first parts (the LP filter coefficients, the adaptive codebook, the adaptive and innovation codebook gains, etc.) the bit-budgets stored in the ROM tables 258 and associated to the intermediate bit rate selected by the selector 257.

Operation 210

In operation 210, a subtractor 260 subtracts from the bit-budget $b_2$ (a) bit-budget budget $b_{LPC}$ for encoding the LP filter coefficients associated to the candidate intermediate bit rate selected by the selector 257, (b) the sum of the bit-budgets $b_{ACBn}$ of the N sub-frames associated to the selected candidate intermediate bit rate, (c) the sum of the bit-budgets $b_{Gn}$ for quantizing the adaptive and innovation codebook gains of the N sub-frames associated to the selected candidate intermediate bit rate, and (d) the bit-budget, associated to the selected intermediate bit rate, for encoding other CELP core module first parts (if they are present), to find a remaining bit-budget (number of bits) $b_4$ still available for encoding the innovation codebook (second CELP core module part). For that purpose, the following relation can be used by the subtractor 260:

$$b_4 = b_2 - b_{LPC} - \sum_{n=0}^{N-1} b_{ACBn} - \sum_{n=0}^{N-1} b_{Gn} - \ldots \tag{3}$$

Operation 211

In operation 211, a FCB bit allocator 261 distributes the remaining bit-budget $b_4$ for encoding the innovation codebook (Fixed CodeBook (FCB); second CELP core module part) between the N sub-frames of the current frame. Specifically, the bit-budget $b_4$ is divided into bit-budgets $b_{FCBn}$ allocated to the various sub-frames n. For example, this can be done by an iterative procedure which divides the bit-budget $b_4$ between the N sub-frames as equally as possible.

In other non-limitative implementations, the FCB bit allocator 261 can be designed by assuming at least one of the following requirements:

I. In case the bit-budget $b_4$ cannot be distributed equally between all the sub-frames, a highest possible (i.e. a larger) bit-budget is allocated to the first sub-frame. As an example, if $b_4$=106 bits, the FCB bit-budget per 4 sub-frames is allocated as 28-26-26-26 bits.

II. If there are more bits available to potentially increase other sub-frame FCB codebooks, the FCB bit-budget (number of bits) allocated to at least one next sub-frames after the first sub-frame (or at least one sub-frame following the first sub-frame) is increased. As an example, if $b_4$=108 bits, the FCB bit-budget per 4 sub-frames is allocated as 28-28-26-26 bits. In an additional example, if $b_4$=110 bits, the FCB bit-budget per 4 sub-frames is allocated as 28-28-28-26 bits.

III. The bit-budget $b_4$ is not necessarily distributed as equally as possible between all the sub-frames but rather to use as much as possible the bit-budget $b_4$. As an example, if $b_4$=87 bits, the FCB bit-budget per 4 sub-frames is allocated as 26-20-20-20 bits rather than e.g. 24-20-20-20 bits or 20-20-20-24 bits when requirement III is not considered. In another example, if $b_4$=91 bits, the FCB bit-budget per 4 sub-frames is allocated as 26-24-20-20 bits while e.g. 20-24-24-20 bits would be allocated if requirement III is not considered. Consequently, in both examples, only 1 bit remains unused when requirement III is considered while 3 bits remain unused otherwise.

Requirement III enables that the FCB bit allocator 261 selects two non-consecutive lines from a FCB configuration table, for example Table 4 herein below. As a non-limitative example, consider $b_4$=87 bits. The FCB bit allocator 261 first chooses line 6 from Table 4 for all sub-frames to be employed to configure the FCB search (this results in 20-20-20-20 bit-budget allocation). Then requirement I changes the allocation such that lines 6 and 7 (24-20-20-20 bits) are employed and requirement III selects the allocation by using lines 6 and 8 (26-20-20-20) from the FCB configuration table (Table 4).

Below is Table 4 as the example of the FCB configuration table (copied from EVS (Reference [2])):

TABLE 4

(expressed in pseudocode)

```
const PulseConfig PulseConfTable[ ] =
 {
    {  7, 4, 2.0f, 1, 0, {8}, TRACKPOS_FREE_ONE },
    { 10, 4, 2.0f, 2, 0, {8}, TRACKPOS_FIXED_EVEN },
    { 12, 4, 2.0f, 2, 0, {8}, TRACKPOS_FIXED_TWO },
    { 15, 4, 2.0f, 3, 0, {8}, TRACKPOS_FIXED_FIRST },
    { 17, 6, 2.0f, 3, 0, {8}, TRACKPOS_FREE_THREE },
    { 20, 4, 2.0f, 4, 0, {4, 8}, TRACKPOS_FIXED_FIRST },      <- line 6
    { 24, 4, 2.0f, 5, 0, {4, 8}, TRACKPOS_FIXED_FIRST },      <- line 7
    { 26, 4, 2.0f, 5, 0, {4, 8}, TRACKPOS_FREE_ONE },         <- line 8
    { 28, 4, 1.5f, 6, 0, {4, 8, 8}, TRACKPOS_FIXED_FIRST },
    { 30, 4, 1.5f, 6, 0, {4, 8, 8}, TRACKPOS_FIXED_TWO },
    { 32, 4, 1.5f, 7, 0, {4, 8, 8}, TRACKPOS_FIXED_FIRST },
    { 34, 4, 1.5f, 7, 0, {4, 8, 8}, TRACKPOS_FREE_THREE },
    { 36, 4, 1.0f, 8, 2, {4, 8, 8}, TRACKPOS_FIXED_FIRST },
    { 40, 4, 1.0f, 9, 2, {4, 8, 8}, TRACKPOS_FIXED_FIRST },
    . . .
 }
```

where the first column corresponds to the number of FCB codebook bits and the fourth column corresponds to the number of FCB pulses per sub-frame. It should be noted that in the example above for $b_4$=87 bits, there does not exist a 22 bit codebook and the FCB allocator thus selects two non-consecutive lines from the FCB configuration table resulting in 26-20-20-20 FCB bit-budget allocation.

IV. In case the bit-budget cannot be equally distributed between all the sub-frames when encoding using a Transition Coding (TC) mode (See Reference [2]), the largest possible (larger) bit-budget is allocated to the sub-frame using a glottal-impulse-shape codebook. As an example, if $b_4$=122 bits and the glottal-impulse-shape codebook is used in the third sub-frame, the FCB bit-budget per 4 sub-frames is allocated as 30-30-32-30 bits.

V. If, after applying requirement IV, there are more bits available to potentially increase another FCB codebook in a TC mode frame, the FCB bit-budget (number of bits) allocated to the last sub-frame is increased. As an example, if $b_4$=116 bits and the glottal-impulse-shape codebook is used in the second sub-frame, the FCB bit-budget per 4 sub-frames is allocated as 28-30-28-30 bits. The idea behind this requirement is to better build the part of the excitation after the onset/transition event which is perceptually more important than the part of excitation before it.

A glottal-impulse-shape codebook may consist of quantized normalized shapes of truncated glottal impulses placed at specific positions as described in Section 5.2.3.2.1 (Glottal pulse codebook search) of Reference [2]. The codebook search then comprises selection of the best shape and the best position. For example, glottal impulse shapes can be represented by codevectors containing only one non-zero element corresponding to candidate impulse positions. Once selected, the position codevector is convolved with the impulse response of a shaping filter.

Using the above requirements the FCB bit allocator 261 may be designed as follows (expressed in C-code):

```
/*-----------------------------------------------------------------*
* acelp_FCB_allocator( )
*
* Routine to allocate fixed innovation codebook bit-budget
*-----------------------------------------------------------------*/
static void acelp_FCB_allocator(
    short *nBits,                  /* i/o: available bit-budget          */
        int fixed_cdk_index[ ],    /* o  : codebook index                */
        short nb_subfr,            /* i  : number of subframes           */
        const short L_subfr,       /* i  : subframe length               */
        const short coder_type,    /* i  : coder type                    */
        const short tc_subfr,      /* i  : TC subframe index             */
        const short fix_first      /* i  : fix first subframe bit-budget */
 )
 {
        short cdbk, sfr, step;
        short nBits_tmp;
        int *p_fixed_cdk_index;
        p_fixed_cdk_index = fixed_cdk_index;
        /* TRANSITION coding: first subframe bit-budget was alreadyfixed, glottal
pulse not in the first subframe */
        if( tc_subfr >= L_SUBFR && fix_first )
        {
            short i;
            for( i = 0; i < nb_subfr; i++ )
            {
                *nBits -= ACELP_FIXED_CDK_BITS(fixed_cdk_index[i]);
        }
        return;
    }
    /* TRANSITION coding: first subframe bit-budget was already fixed, glottal
pulse in the first subframe */
    sfr = 0;
    if( fix_first )
    {
            *nBits -= ACELP_FIXED_CDK_BITS(fixed_cdk_index[0]);
            sfr = 1;
            p_fixed_cdk_index++;
            nb_subfr = 3;
    }
    /* distribute the bit-budget equally between subframes */
    cdbk = 0;
    while( fcb_table(cdbk,L_subfr)*nb_subfr <= *nBits )
    {
            cdbk++;
    }
    cdbk--;
        set_i( p_fixed_cdk_index, cdbk, nb_subfr );
        nBits_tmp = 0;
        if( cdbk >= 0 )
        {
             nBits_tmp = fcb_table(cdbk,L_subfr);
        }
        else
        {
            nBits_tmp = 0;
        }
        *nBits -= nBits_tmp * nb_subfr;
```

-continued

```
            /* try to increase the FCB bit-budget of the first subframe(s) */
            step = fcb_table(cdbk+1,L_subfr) - nBits_tmp;
            while( *nBits >= step )
            {
                (*p_fixed_cdk_index)++;
                *nBits -= step;
                p_fixed_cdk_index++;
            }
            /* try to increase the FCB of the first subframe in cases when the next
step is lower than the current step */
        step = fcb_table(fixed_cdk_index[sfr]+1,L_subfr) -
fcb_table(fixed_cdk_index[sfr],L_subfr);
        if( *nBits >= step && cdbk >= 0)
        {
                fixed_cdk_index[sfr]++;
                *nBits -= step;
                if( *nBits >= step &&fixed_cdk_index[sfr+1] ==
fixed_cdk_index[sfr] - 1)
                {
                    sfr++;
                    fixed_cdk_index[sfr]++;
                    *nBits -= step;
                }
        }
        /* TRANSITION coding: allocate highest FCBQ bit-budget to the subframe
with the glottal-shape codebook */
        if( tc_subfr >= L_SUBFR )
        {
                short tempr;
                SWAP( fixed_cdk_index[0], fixed_cdk_index[tc_subfr/
                L_SUBFR] );
                /* TRANSITION coding: allocate second highest FCBQ bit-budget
 to the last subframe */
                if( tc_subfr/L_SUBFR < nb_subfr - 1 )
                {
                  SWAP( fixed_cdk_index[(tc_subfr -
                  L_SUBFR)/L_SUBFR],
 fixed_cdk_index[nb_subfr-1] );
                }
            }
            /* when subframe length > L_SUBFR, number of bits instead of codebook
 index is signalled */
            if( L_subfr > L_SUBFR )
            {
                short i, j;
                for( i = 0; i < nb_subfr; i++ )
                {
                    j = fixed_cdk_index[i];
                    fixed_cdk_index[i] = fast_FCB_bits_2sfr[j];
                }
            }
            return;
    }
    /*-----------------------------------------------------------------*
    * fcb_table( )
    *
    * Selection of fixed innovation codebook bit-budget table
    *-----------------------------------------------------------------*/
    static short fcb_table(
        const short n,
        const short L_subfr
    )
    {
        short out;
        out = PulseConfTable[n].bits;
        if( L_subfr > L_SUBFR )
            {
              out = fast_FCB_bits_2sfr[n];
            }
            return( out );
    }
```

where function SWAP( ) swaps/interchanges the two input values. The function fcb_table( ) then selects the corresponding line of the FCB (fixed or innovation codebook) configuration table (as defined above) and returns the number of bits needed for encoding the selected FCB (fixed or innovation codebook).

Operation 212

A counter 262 determines the sum of the bit-budgets (number of bits) $b_{FCBn}$ allocated to the N various sub-frames for encoding the innovation codebook (Fixed CodeBook (FCB); second CELP core module part).

$$\Sigma_{n=0}^{N-1} b_{FCBn} \tag{4}$$

Operation 213

In operation 213, a subtractor 263 determines the number of bits $b_5$ remaining after encoding of the innovation codebook, using the following relation:

$$b_5 = b_4 - \sum_{n=0}^{N-1} b_{FCBn}. \tag{5}$$

Ideally, after encoding of the innovation codebook, the number of remaining bits $b_5$ is equal to zero. However, it may not be possible to achieve this result because the granularity of the innovation codebook index is greater than 1 (usually 2-3 bits). Consequently, a small number of bits often remain unemployed after encoding of the innovation codebook.

Operation 214

In operation 214, a bit allocator 264 assigns the unemployed bit-budget (number of bits) $b_5$ to increase the bit-budget of one of the CELP core module parts (CELP core module first parts) except of the innovation codebook. For example, the unemployed bit-budget $b_5$ can be used to increase the bit-budget $b_{LPC}$ obtained from the ROM tables 258, using the following relation:

$$b'_{LPC}=b_{LPC}+b_5. \tag{6}$$

The unemployed bit-budget $b_5$ may also be used to increase the bit-budget of other CELP core module first parts, for example the bit-budgets $b_{ACBn}$ or $b_{Gn}$. Also, the unemployed bit-budget $b_5$, when greater than 1 bit, can be redistributed between two or even more CELP core module first parts. Alternatively, the unemployed bit-budget $b_5$ can be used to transmit FEC information (if not already counted in the supplementary codec modules), for example a signal class (See Reference [2]).

High Bit Rate CELP

Traditional CELP has limitations of scalability and complexity when it is used at high bit rates. To overcome these limitations, the CELP model can be extended by a special transform-domain codebook as described in References [3] and [4]. In contrast to traditional CELP where the excitation is composed from the adaptive and the innovation excitation contributions only, the extended model introduces a third part of the excitation, namely a transform-domain excitation contribution. The additional transform-domain codebook usually comprises a pre-emphasis filter, a time-domain to frequency-domain transformation, a vector quantizer, and a transform-domain gain. In the extended model, a substantial number (at least tens) of bits is assigned to the vector quantizer in every sub-frame.

In high bit rate CELP, bit-budget is allocated to the CELP core module parts using the procedure as described above. Following this procedure, the sum of the bit-budgets $b_{FCBn}$ for encoding the innovation codebook in the N sub-frames should be equal or approach bit-budget $b_4$. In the high bit rate CELP, the bit-budgets $b_{FCBn}$ are usually modest, and the number of unemployed bits $b_5$ is relatively high and is used to encode the transform-domain codebook parameters.

First, the sum of the bit-budget $b_{TDGn}$ for encoding the transform-domain gain in the N sub-frames and eventually the bit-budget of other transform-domain codebook parameters except the bit-budget for the vector quantizer are subtracted from the unemployed bit-budget $b_5$, using the following relation:

$$b_7 = b_5 - \sum_{n=0}^{N-1} b_{TDGn} - \ldots \tag{7}$$

Then, the remaining bit-budget (number of bits) $b_7$ is allocated to the vector quantizer within the transform-domain codebook and distributed among all sub-frames. The bit-budget (number of bits) by sub-frame of the vector quantizer is denoted as $b_{VQn}$. Depending on the vector quantizer being used (for example an AVQ quantizer as used in EVS), the quantizer does not consume all of the allocated bit-budget $b_{VQn}$ leaving a small variable number of bits available in each sub-frame. These bits are floating bits employed in the following sub-frame within the same frame. For a better effectiveness of the transform-domain codebook, a slightly higher (larger) bit-budget (number of bits) is allocated to the vector quantizer in the first sub-frame. An example of implementation is given in the following pseudocode:

```
b_tmp = ⌊ b_7 / N ⌋
for( n = 0; n < N; n++ )
{
    b_VQn = b_tmp
}
b_VQ0 = b_tmp + (b_7 − N*b_tmp)
```

where $\lfloor x \rfloor$ denotes the largest integer less than or equal to x and N is the number of sub-frames in one frame. Bit-budget (number of bits) $b_7$ is distributed equally between all the sub-frames while the bit-budget for the first sub-frame is eventually slightly increased by up to N−1 bits. Consequently, in high bit rate CELP, there are no remaining bits after this operation.

Other Aspects Related to the Extended EVS Codec

In many instances, there are more than one alternative for encoding a given CELP core module part. In complex codecs like EVS several different techniques are available for encoding a given CELP core module part and the selection of one technique is usually made on the basis of the CELP core module bit rate (the core module bit rate corresponds to the bit-budget $b_{core}$ of the CELP core module multiplied by number of frames per second). An example is gain quantization where there are three (3) different techniques available in the EVS codec as described in Reference [2], Generic Coding (GC) mode:

- a vector quantizer based on sub-frame prediction (GQ1; used at core bit rates equal or below 8.0 kbps);
- a memory-less vector quantizer of adaptive and innovation gains (GQ2; used at core bit rates higher than 8 kbps and lower or equal to 32 kbps); and
- two scalar quantizers (GQ3; used at core bit rates higher than 32 kbps).

Also, at a constant codec total bit rate $b_{total}$, different techniques for encoding and quantizing a given CELP core module part can be switched on a frame by frame basis depending on the CELP core module bit rate. An example is parametric stereo coding mode at 48 kbps, in which different gain quantizers (See Reference [2]) are used in different frames as shown in Table 5 below:

TABLE 5

Example usage of different gain quantizers in the extended EVS codec with fluctuating core bit rate

| frame # | k | k + 1 | k + 2 | k + 3 | k + 4 | k + 5 | k + 6 |
|---|---|---|---|---|---|---|---|
| core bit rate | 35.20 kbps | 38.05 kbps | 31.35 kbps | 32.00 kbps | 32.45 kbps | 34.30 kbps | 33.60 kbps |
| gain quantizer | GQ3 | GQ3 | GQ2 | GQ2 | GQ3 | GQ3 | GQ3 |

It is also interesting to note that there can be different bit-budget allocations for a given CELP core module bit rate depending on the codec configuration. As an example, encoding of the primary channel in EVS-based TD stereo coding mode works, in a first scenario, at a total codec bit rate of 16.4 kbps and, in a second scenario, at a total codec bit rate of 24.4 kbps. There can happen in both scenarios that the CELP core module bit rate is the same even though the total codec bit rate is different. But a different codec configuration can lead to a different bit-budget distribution.

In the EVS-based stereo framework, the different codec configurations between 16.4 kbps and 24.4 kbps is related to a different CELP core internal sampling rate which is 12.8 kHz at 16.4 kbps and 16 kHz at 24.4 kbps, respectively. Thus CELP core module coding with four (4), respectively five (5) sub-frames is employed and a corresponding bit-budget distribution is used. Below are shown these differences between the two mentioned total codec bit rates (one value per table cell corresponds to one parameter per frame while more values correspond to parameters per sub-frames).

TABLE 6

Bit-budget comparison for same core bit rate at two different total bit rates.

| total bit rate | 16.4 kbps | 24.40 kbps |
|---|---|---|
| core bit rate | 13.30 kbps | 13.30 kbps |
| core module part | bit-budget [bits] | bit-budget [bits] |
| Signaling | 7 | 9 |
| LPCQ | 36 | 42 |
| | 5 | 5 |
| ACBQ | 10 + 6 + 10 + 6 | 10 + 6 + 10 + 6 + 6 |
| FCBQ | 43 + 36 + 36 + 36 | 26 + 26 + 26 + 26 + 26 |
| GQ | 5 | 5 |
| | 6 + 6 + 6 + 6 | 6 + 6 + 6 + 6 + 6 |
| ACB low-pass filtering flag | 1 + 1 + 1 + 1 | 1 + 1 + 1 + 1 + 1 |
| FEC | 2 | 2 |
| Total | 266 | 266 |

Accordingly, the above table shows that there can be different bit-budget distributions for the same core bit rate at different codec total bit rates.

Encoder Process Flow

When the supplementary codec modules comprises a stereo module and a BWE module, the flow of the encoder process may be as follows:

- Stereo side (or secondary channel) information is encoded and the bit-budget allocated thereto is subtracted from the codec total bit-budget. Codec signaling bits are also subtracted from the total bit-budget.
- The bit-budget for encoding the BWE supplementary module is then set based on the codec total bit-budget minus the stereo module and codec signaling bit-budgets.
- The BWE bit-budget is subtracted from the codec total bit-budget minus the "stereo supplementary module" and "codec signaling" bit-budgets.
- The above-described procedure for allocating the core module bit-budget is performed.
- CELP core module is encoded.
- BWE supplementary module is encoded.

Decoder

The CELP core module bit rate is not directly signaled in the bit-stream but is computed at the decoder based on the bit-budgets of the supplementary codec modules. In the example of implementation comprising stereo and BWE supplementary modules, the following procedure could be followed:

- Codec signaling is written/read to/from the bit-stream.
- Stereo side (or secondary channel) information is written/read to/from the bit-stream. The bit-budget for coding the stereo side information fluctuates and depends on the stereo side signaling and on the technique used for coding. Basically (a) in parametric stereo the arithmetic coder and the stereo side signaling determines when to stop the writing/reading of the stereo side information while (b) in time-domain stereo coding the mixing factor and coding mode determine the bit-budget of the stereo side information.
- The bit-budgets for codec signaling and the stereo side information are subtracted from the codec total bit-budget.
- Then, the bit-budget for the BWE supplementary module is also subtracted from the codec total bit-budget. The BWE bit-budget granularity is usually small: a) there is only one bit rate per audio bandwidth (WB/SWB/FB) and the bandwidth information is transmitted as part of the codec signaling in the bit-stream, or b) the bit-budget for a particular bandwidth may have a certain granularity and the BWE bit-budget is determined from the codec total bit-budget minus the stereo module bit-budget. In an illustrative embodiment, for instance the SWB time-domain BWE may have a bit rate of 0.95 kbps, 1.6 kbps or 2.8 kbps depending on the codec total bit rate minus the stereo module bit rate.

What remains is the CELP core bit-budget $b_{core}$, which is an input parameter to the bit-budget allocation procedure described in the foregoing description. The same allocation is called for at the CELP encoder (just after pre-processing) and at the CELP decoder (at the beginning of CELP frame decoding).

The following is a C-code excerpt from an extended EVS-based codec for Generic Coding bit-budget allocation, given by way of example only.

```
void config_acelp1 (
    const int total_brate,          /* i : total bit rate              */
    const int core_brate_inp,       /* i : core bit rate               */
    ACELP_config *acelp_cfg,        /* i : ACELP bit allocation        */
    const short signaling_bits,     /* i : number of signaling bits    */
```

-continued

```
    short *nBits_es_Pred,          /* o : number of bits for Es_pred Q  * /
    short *unbits                  /* o : number of unused bits         * /
)
{
    /*-----------------------------------------------------------------*
        * Find intermediate bit rate
        *-----------------------------------------------------------------*/
        i = 0;
        while( i < SIZE_BRATE_INTERMED_TBL )
        {
                if( core_brate_inp < brate_intermed_tbl [i] )
                {
                        break;
                }
                i ++;
        }
     core_brate = brate_intermed_tbl [i];
    /*-----------------------------------------------------------------*
     * ACELP bit allocation
     *-----------------------------------------------------------------*/
     /* Set the bit-budget */
     bits = (short) (core_brate_inp / 50);
     /* Subtract core module signaling bits */
    bits -= signaling_bits;
    /* ----------------------------------------------------------------*
    * LPCQ bit-budget
    *-----------------------------------------------------------------*/
    /* LSF Q bit-budget */
    acelp_cfg->lsf_bits = LSF_bits_tbl
    [ALLOC_IDX(core_brate)];
    if( total_brate <= 9600 )
    {
            acelp_cfg->lsf_bits = 31;
    }
    else if( total_brate <= 20000 )
    {
            acelp_cfg->lsf_bits = 36;
    }
    else
    {
            acelp_cfg->lsf_bits = 41;
        }
        bits -= acelp_cfg->lsf_bits;
        /* mid-LSF Q bit-budget */
        acelp_cfg->mid_lsf_bits =mid_LSF_bits_tbl (ALLOC_IDX(core_brate)];
        bits -= acelp_cfg->mid_lsf bits;
        /*-----------------------------------------------------------------*
        /* gain Q bit-budget - part 1 */
        *-----------------------------------------------------------------*
     *nBits_es_Pred =Es_pred_bits_tbl[ALLOC_IDX(core_brate)];
     bits -= *nBits_es Pred;
    /*-----------------------------------------------------------------*
     * Supplementary information for FEC
     *-----------------------------------------------------------------*/
     acelp_cfg->FEC_mode = 0;
     if ( core_brate >= ACELP_11k60 )
     {
            acelp_cfg->FEC_mode = 1;
            bits -= FEC_BITS_CLS;
            if( total_brate >= ACELP_16k40 )
            {
                    acelp_cfg->FEC_mode = 2;
                    bits -= FEC_BITS_ENR;
            }
            if( total_brate >= ACELP_32k )
            {
                acelp_cfg->FEC_mode = 3;
                bits -= FEC_BITS_POS;
            }
    }
  /*-----------------------------------------------------------------*
    * LP filtering of the adaptive excitation
    *-----------------------------------------------------------------*/
    if( core_brate < ACELP_11k60 )
    {
                acelp_cfg->ltf_mode =LOW_PASS;
        }
        else if( core_brate >= ACELP_11k60 )
        {
```

-continued

```
                acelp_cfg->ltf_mode = NORMAL_OPERATION;
                bits -= nb_subfr;
        }
        else
        {
                acelp_cfg->ltf_mode = FULL_BAND;
        }
/*-----------------------------------------------------------------*
* pitch, innovation, gains bit-budget
/*-----------------------------------------------------------------*/
acelp_cfg->fcb_mode = 0;
/* pitch Q & gain Q bit-budget - part 2*/
for( i=0; i<nb_subfr; i++ )
{
                acelp_cfg->pitch_bits[i]
                = ACB_bits_tbl[ALLOC_IDX(core_brate,i)];
                acelp_cfg->gains_mode[i]
                = gain_bits_tbl[ALLOC_IDX(core_brate,i)];
                bits -=acelp_cfg->pitch_bits[i];
                bits -=acelp_cfg->gains_mode[i];
}
/* innovation codebook bit-budget */
if( core_brate_inp >= MIN_BRATE_AVQ_EXC )
{
                for( i=0; i<nb_subfr; i++ )
                {
                        acelp_cfg->fixed_cdk_index[i]
                        =FCB_bits_tbl[ALLOC_IDX(core_brate,
                        i)];
                        bits -= acelp_cfg->fixed_cdk_index[i];
                }
}
else
{
                acelp_cfg->fcb_mode = 1;
                acelp_FCB_allocator( &bits, acelp_cfg->fixed_cdk_index, nb_subfr,
                tc_subfr, fix_first );
        }
        /* AVQ codebook */
        if( core_brate_inp >= MIN_BRATE_AVQ_EXC )
        {
                for( i=0; i<nb_subfr; i++ )
                {
                        bits -= G_AVQ_BITS;
                }
                        if(core_brate_inp>=MIN_BRATE_AVQ_EXC &&
                        core_brate_inp<=MAX_BRATE_AVQ_EXC_TD )
                {
                        /* harmonicity flag ACELP AVQ */
                        bits--;
                }
                bit_tmp = bits / nb_subfr;
                set_s( acelp_cfg->AVQ_cdk_bits, bit_tmp, nb_subfr );
                bits -= bit_tmp * nb_subfr;
                bit_tmp = bits % nb_subfr;
                acelp_cfg->AVQ_cdk_bits[0] += bit_tmp;
                bits -= bit_tmp;
}
/*-----------------------------------------------------------------*
* unemployed bits handling
*-----------------------------------------------------------------*/
acelp_cfg->ubits =0;                                    /* unused bits */
if( bits > 0 )
{
                /* increase LPCQ bits */
                acelp_cfg->lsf_bits += bits;
                if( acelp_cfg->lsf_bits > 46 )
                {
                        acelp_cfg->ubits = acelp_cfg->lsf_bits - 46;
                        acelp_cfg->lsf_bits = 46;
                }
}
        return;
}
```

Figure 3:
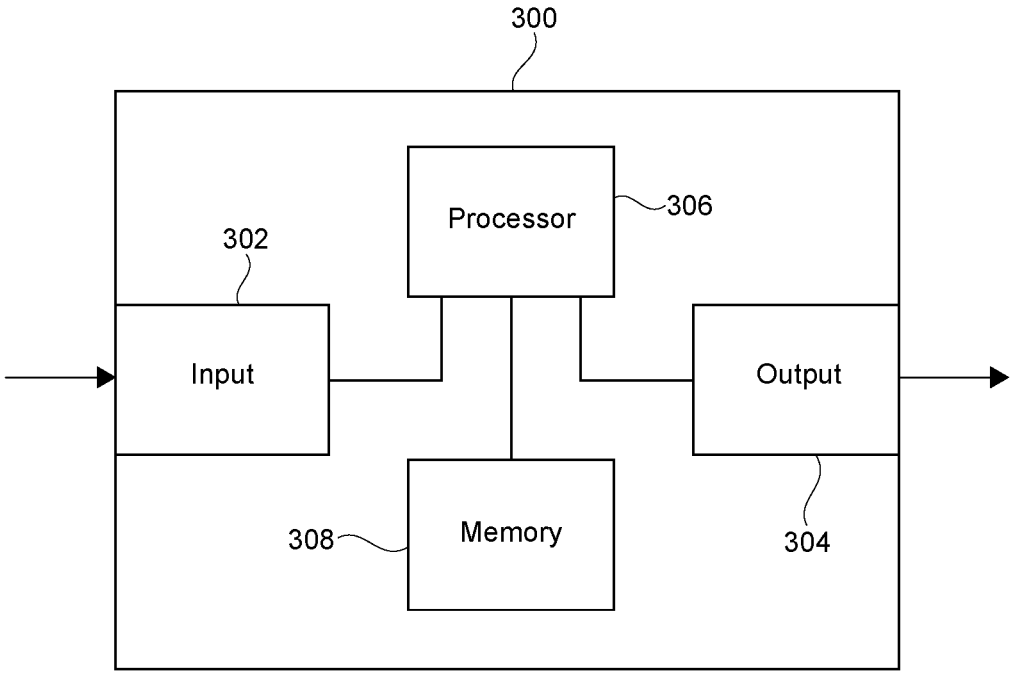
FIG. 3 is a simplified block diagram of an example configuration of hardware components forming the bit-budget allocating method and device of the present disclosure.

FIG. 3 is a simplified block diagram of an example configuration of hardware components forming the bit-budget allocating device and implementing the bit-budget allocating method.

The bit-budget allocating device may be implemented as a part of a mobile terminal, as a part of a portable media player, or in any similar device. The bit-budget allocating device (identified as 300 in FIG. 3) comprises an input 302, an output 304, a processor 306 and a memory 308.

The input 302 is configured to receive for example the codec total bit-budget $b_{total}$ (FIG. 2). The output 304 is configured to supply the various allocated bit-budgets. The input 302 and the output 304 may be implemented in a common module, for example a serial input/output device.

The processor 306 is operatively connected to the input 302, to the output 304, and to the memory 308. The processor 306 is realized as one or more processors for executing code instructions in support of the functions of the various modules of the bit-budget allocating device of FIG. 2.

The memory 308 may comprise a non-transient memory for storing code instructions executable by the processor 306, specifically a processor-readable memory comprising non-transitory instructions that, when executed, cause a processor to implement the operations and modules of the bit-budget allocating method and device of FIG. 2. The memory 308 may also comprise a random access memory or buffer(s) to store intermediate processing data from the various functions performed by the processor 306.

Those of ordinary skill in the art will realize that the description of the bit-budget allocating method and device are illustrative only and are not intended to be in any way limiting. Other embodiments will readily suggest themselves to such persons with ordinary skill in the art having the benefit of the present disclosure. Furthermore, the disclosed bit-budget allocating method and device may be customized to offer valuable solutions to existing needs and problems related to allocation or distribution of bit-budget.

In the interest of clarity, not all of the routine features of the implementations of the bit-budget allocating method and device are shown and described. It will, of course, be appreciated that in the development of any such actual implementation of the bit-budget allocating method and device, numerous implementation-specific decisions may need to be made in order to achieve the developer's specific goals, such as compliance with application-, system-, network- and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of sound processing having the benefit of the present disclosure.

In accordance with the present disclosure, the modules, processing operations, and/or data structures described herein may be implemented using various types of operating systems, computing platforms, network devices, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used. Where a method comprising a series of operations and sub-operations is implemented by a processor, computer or a machine and those operations and sub-operations may be stored as a series of non-transitory code instructions readable by the processor, computer or machine, they may be stored on a tangible and/or non-transient medium.

Modules of the bit-budget allocating method and device as described herein may comprise software, firmware, hardware, or any combination(s) of software, firmware, or hardware suitable for the purposes described herein.

In the bit-budget allocating method as described herein, the various operations and sub-operations may be performed in various orders and some of the operations and sub-operations may be optional.

Although the present, foregoing disclosure is made by way of non-restrictive, illustrative embodiments, these embodiments may be modified at will within the scope of the appended claims without departing from the spirit and nature of the present disclosure.

REFERENCES

The following references are referred to in the present specification and the full contents thereof are incorporated herein by reference.

[1] ITU-T Recommendation G.718: "Frame error robust narrowband and wideband embedded variable bit-rate coding of speech and audio from 8-32 kbps," 2008.

[2] 3GPP Spec. TS 26.445: "Codec for Enhanced Voice Services (EVS). Detailed Algorithmic Description," v.12.0.0, September 2014.

[3] B. Bessette, "Flexible and scalable combined innovation codebook for use in CELP coder and decoder," U.S. Pat. No. 9,053,705, June 2015.

[4] V. Eksler, "Transform-Domain Codebook in a CELP Coder and Decoder," US Patent Publication 2012/0290295, November 2012, and U.S. Pat. No. 8,825,475, September 2014.

[5] F. Baumgarte, C. Faller, "Binaural cue coding—Part I: Psychoacoustic fundamentals and design principles," IEEE Trans. Speech Audio Processing, vol. 11, pp. 509-519, November 2003.

[6] Tommy Vaillancourt, "Method and system using a long-term correlation difference between left and right channels for time domain down mixing a stereo sound signal into primary and secondary channels," PCT Application WO2017/049397A1.

What is claimed is:

1. A method of encoding or decoding a sound signal represented by a plurality of first parts and a second part of a CELP core module in a sound signal encoder or decoder, comprising in a frame of the sound signal comprising sub-frames:

allocating to the first CELP core module parts respective bit-budgets;

allocating to the second CELP core module part a bit-budget remaining after allocating to the first CELP core module parts the said respective bit-budgets, wherein allocating the second CELP core module part bit-budget comprises (a) initially distributing an equal number of bits from the second CELP core module part bit-budget to the sub-frames of the frame and (b) allocating bits from the second CELP core module part bit-budget remaining after the initial bit distribution to at least one of the sub-frames of the frame;

encoding or decoding the first CELP core module parts using the respective, first CELP core module parts bit-budgets; and encoding or decoding the second CELP core module part using the second CELP core module part bit-budget distributed between the sub-frames of the frame.

2. The sound signal encoding or decoding method of claim 1, wherein the at least one subframe is the first sub-frame of the frame of the sound signal.

3. The sound signal encoding or decoding method of claim 2, wherein the at least one subframe comprises at least one sub-frame following the first sub-frame of the frame of the sound signal.

4. The sound signal encoding or decoding method of claim 1, wherein bits from the second CELP core module part bit-budget remain after the initial bit distribution if it is not possible to distribute all the bits from the second CELP core module part bit-budget equally between the sub-frames of the frame.

5. The sound signal encoding or decoding method of claim 1, wherein:

the CELP core module uses, in one sub-frame of the frame of the sound signal, a glottal-impulse-shape codebook; and the at least one sub-frame of the frame to which remaining bits are allocated is the sub-frame using the glottal-impulse-shape codebook.

6. The sound signal encoding or decoding method of claim 1, wherein allocating to the first CELP core module parts respective bit-budgets comprises allocating to the first CELP core module parts respective bit-budgets assigned to the first CELP core module parts by bit-budget allocation tables.

7. The sound signal encoding or decoding method according to claim 1, using supplementary codec modules and comprising:

allocating a bit-budget to the supplementary codec modules; and subtracting, from a total codec bit-budget, the supplementary codec modules bit-budget to determine a CELP core module bit-budget to be distributed between the first CELP core module parts bit-budgets and the second CELP core module part bit-budget.

8. The sound signal encoding or decoding method according to claim 1, using supplementary codec modules and comprising:

allocating a first bit-budget to codec signaling;

allocating a second bit-budget to the supplementary codec modules;

subtracting, from a total codec bit-budget, the first and second bit-budgets to determine a CELP core module bit-budget to be distributed between the first CELP core module parts bit-budgets and the second CELP core module part bit-budget.

9. The sound signal encoding or decoding method according to claim 7, comprising determining an unemployed bit-budget including subtracting from the total codec bit-budget (a) the bit-budget allocated to the supplementary codec modules, (b) the bit-budgets allocated to the first CELP core module parts, and (c) the bit-budget allocated to the second CELP core module part.

10. The sound signal encoding or decoding method according to claim 9, comprising allocating the unemployed bit-budget to encoding of at least one of the first CELP core module parts.

11. The sound signal encoding or decoding method according to claim 9, comprising allocating the unemployed bit-budget to encoding of a transform-domain codebook.

12. The sound signal encoding or decoding method according to claim 11, wherein allocating the unemployed bit-budget to encoding of the transform-domain codebook comprises allocating a first part of the unemployed bit-budget to transform-domain parameters, and allocating a second part of the unemployed bit-budget to a vector quantizer within the transform-domain codebook.

13. The sound signal encoding or decoding method according to claim 12, comprising distributing the second part of the unemployed hit-budget among all the sub-frames of the frame of the sound signal.

14. The sound signal encoding or decoding method according to claim 13, wherein a larger bit-budget is allocated to a first sub-frame of the frame.

15. The sound signal encoding or decoding method of claim 5, further comprising increasing the bit-budget of the last sub-frame of the frame.

16. A device for encoding or decoding a sound signal represented by a plurality of first parts and a second part of a CELP core module in a sound signal encoder or decoder, comprising for a frame of the sound signal comprising sub-frames:

at least one processor; and a memory coupled to the processor and storing non-transitory instructions that when executed cause the processor to implement:

a first allocator of respective bit-budgets to the first CELP core module parts;

a second allocator, to the second CELP core module part, of a bit-budget remaining after allocating to the first CELP core module parts the said respective bit-budgets, wherein the second allocator (a) initially distributes an equal number of bits from the second CELP core module part bit-budget to the sub-frames of the frame and (b) allocates bits from the second CELP core module part bit-budget remaining after the initial bit distribution to at least one of the sub-frames of the frame; and a core module encoder or decoder for encoding or decoding (a) the first CELP core module parts using the respective, first CELP core module parts bit-budgets and (b) the second CELP core module part using the second CELP core module part bit-budget distributed between the sub-frames of the frame.

17. The sound signal encoding or decoding device of claim 16, wherein the at least one subframe is the first sub-frame of the frame of the sound signal.

18. The sound signal encoding or decoding device of claim 17, wherein the at least one sub-frame comprises at least one sub-frame following the first sub-frame of the frame of the sound signal.

19. The sound signal encoding or decoding device of claim 16, wherein bits from the second CELP core module part bit-budget remain after the initial bit distribution if it is not possible to distribute all the bits from the second CELP core module part bit-budget equally between the sub-frames of the frame.

20. The sound signal encoding or decoding device of claim 16, wherein:

the CELP core module uses, in one sub-frame of the frame of the sound signal, a glottal-impulse-shape codebook; and the at least one sub-frame of the frame to which remaining bits are allocated is the sub-frame using the glottal-impulse-shape codebook.

21. The sound signal encoding or decoding device of claim 16, wherein the first allocator allocates to the first CELP core module parts respective bit-budgets assigned to the first CELP core module parts by bit-budget allocation tables.

22. The sound signal encoding or decoding device according to claim 16, using supplementary codec modules and comprising:

an allocator of a bit-budget to the supplementary codec modules;

a subtractor of the supplementary codec modules bit-budget from a total codec bit-budget to determine a CELP core module bit-budget to be distributed between the first CELP core module parts bit-budgets and the second CELP core module part bit-budget.

23. The sound signal encoding or decoding device according to claim 16, using supplementary codec modules and comprising:

an allocator of a first bit-budget to codec signaling;

an allocator of a second bit-budget to the supplementary codec modules;

a subtractor of the first and second bit-budgets from a total codec bit-budget to determine a CELP core module bit-budget to be distributed between the first CELP core module parts bit-budgets and the second CELP core module part bit-budget.

24. The sound signal encoding or decoding device according to claim 22, comprising, for determining an unemployed bit-budget, a subtractor of (a) the bit-budget allocated to the supplementary codec modules, (b) the bit-budgets allocated to the first CELP core module parts, and (c) the bit-budget allocated to the second CELP core module part from the total codec bit-budget.

25. The sound signal encoding or decoding device according to claim 24, comprising an allocator of the unemployed bit-budget to encoding of at least one of the first CELP core module parts.

26. The sound signal encoding or decoding device according to claim 24, comprising an allocator of the unemployed bit-budget to encoding of a transform-domain codebook.

27. The sound signal encoding or decoding device according to claim 26, wherein the allocator of the unemployed bit-budget to encoding of the transform-domain codebook allocates a first part of the unemployed bit-budget to transform-domain parameters, and allocates a second part of the unemployed bit-budget to a vector quantizer within the transform-domain codebook.

28. The sound signal encoding or decoding device according to claim 27, wherein the allocator of the unemployed bit-budget distributes the second part of the unemployed bit-budget among all the sub-frames of the frame of the sound signal.

29. The sound signal encoding or decoding device according to claim 28, wherein the allocator of the unemployed bit-budget allocates a larger bit-budget to a first sub-frame of the frame.

30. The sound signal encoding or decoding device of claim 20, wherein the second allocator also increases the bit-budget of the last sub-frame of the frame.

31. A device for encoding or decoding a sound signal represented by a plurality of first parts and a second part of a CELP core module in a sound signal encoder or decoder, comprising for a frame of the sound signal comprising sub-frames:

at least one processor; and a memory coupled to the processor and storing non-transitory instructions that when executed cause the processor to:

allocate respective bit-budgets to the first CELP core module parts;

allocate, to the second CELP core module part, a bit-budget remaining after allocating to the first CELP core module parts the said respective hit-budgets, wherein allocating the second CELP core module part hit-budget comprises (a) initially distributing an equal number of bits from the second CELP core module part bit-budget to the sub-frames of the frame and (b) allocating bits from the second CELP core module part hit-budget remaining after the initial bit distribution to at least one of the sub-frames of the frame;

encode or decode the first CELP core module parts using the respective, first CELP core module parts bit-budgets; and encode or decode the second CELP core module part using the second CELP core module part bit-budget distributed between the sub-frames of the frame.

32. A method of encoding or decoding a sound signal represented by a plurality of first parts and a second part of a CELP core module in a sound signal encoder or decoder, comprising:

storing bit-budget allocation tables assigning, for each of a plurality of intermediate bit rates, respective bit-budgets to the first CELP core module parts;

determining a CELP core module bit rate;

selecting one of the intermediate bit rates based on the determined CELP core module bit rate;

allocating to the first CELP core module parts the respective bit-budgets assigned by the bit-budget allocation tables for the selected intermediate bit rate; and allocating to the second CELP core module part a bit-budget remaining after allocating to the first CELP core module parts the respective bit-budgets assigned by the bit-budget allocation tables for the selected intermediate bit rate; wherein (a) the CELP core module uses, in one sub-frame of a frame of the sound signal, a glottal-impulse-shape codebook, and (b) allocating the second CELP core module part bit-budget comprises (a) initially distributing an equal number of bits from the second CELP core module part bit-budget to the sub-frames of the frame and (b) allocating bits from the second CELP core module part bit-budget remaining after the initial bit distribution to the sub-frame comprising the glottal-impulse-shape codebook;

encoding or decoding the first CELP core module parts using the respective, first CELP core module parts bit-budgets; and encoding or decoding the second CELP core module part using the second CELP core module part bit-budget distributed between the sub-frames of the frame.

33. The sound signal encoding or decoding method according to claim 32, wherein:

the first CELP core module parts comprise at least one of LP filter coefficients, a CELP adaptive codebook, a CELP adaptive codebook gain and a CELP innovation codebook gain; and the second CELP core module part comprises a CELP innovation codebook.

34. The sound signal encoding or decoding method according to claim 32, wherein selecting one of the intermediate bit rates comprises selecting a nearest higher one of the intermediate bit rates to the CELP core module bit rate.

35. The sound signal encoding or decoding method according to claim 32, wherein selecting one of the intermediate bit rates comprises selecting a nearest lower one of the intermediate bit rates to the CELP core module bit rate.

36. A device for encoding or decoding a sound signal represented by a plurality of first parts and a second part of a CELP core module in a sound signal encoder or decoder, comprising:

at least one processor; and a memory coupled to the processor and storing non-transitory instructions that when executed cause the processor to implement:

bit-budget allocation tables assigning, for each of a plurality of intermediate bit rates, respective bit-budgets to the first CELP core module parts;

a calculator of a CELP core module bit rate;

a selector of one of the intermediate bit rates based on the calculated CELP core module bit rate;

a first allocator of the respective hit-budgets assigned by the bit-budget allocation tables, for the selected intermediate bit rate, to the first CELP core module parts; and a second allocator, to the second CELP core module part, of a bit-budget remaining after allocating to the first CELP core module parts the respective bit-budgets assigned by the bit-budget allocation tables for the selected intermediate bit rate; wherein (a) the CELP core module uses, in one sub-frame of a frame of the sound signal, a glottal-impulse-shape codebook, and (b) the second allocator (a) initially distributes an equal number of bits from the second CELP core module part bit-budget to the sub-frames of the frame and (b) allocates bits from the second CELP core module part bit-budget remaining after the initial bit distribution to the sub-frame comprising the glottal-impulse-shape codebook; and a core module encoder or decoder for encoding or decoding (a) the first CELP core module parts using the respective, first CELP core module parts bit-budgets and (b) the second CELP core module part using the second CELP core module part bit-budget distributed between the sub-frames of the frame.

37. The sound signal encoding or decoding device according to claim 36, wherein:

the first CELP core module parts comprise at least one of LP filter coefficients, a CELP adaptive codebook, a CELP adaptive codebook gain and a CELP innovation codebook gain; and the second CELP core module part comprises a CELP innovation codebook.

38. The sound signal encoding or decoding device according to claim 36, wherein the selector of one of the intermediate bit rates selects a nearest higher one of the intermediate bit rates to the CELP core module bit rate.

39. The sound signal encoding or decoding device according to claim 36, wherein the selector of one of the intermediate hit rates selects a nearest lower one of the intermediate bit rates to the CELP core module bit rate.

40. A device for encoding or decoding a sound signal represented by a plurality of first parts and a second part of a CELP core module in a sound signal encoder or decoder, comprising:

at least one processor; and a memory coupled to the processor and storing non-transitory instructions that when executed cause the processor to:

store bit-budget allocation tables assigning, for each of a plurality of intermediate bit rates, respective bit-budgets to the first CELP core module parts;

determine a CELP core module bit rate;

select one of the intermediate bit rates based on the determined CELP core module hit rate;

allocate the respective bit-budgets assigned by the bit-budget allocation tables, for the selected intermediate bit rate, to the first CELP core module parts; and allocate, to the second CELP core module part, a bit-budget remaining after allocating to the first CELP core module parts the respective bit-budgets assigned by the bit-budget allocation tables for the selected intermediate bit rate; wherein (a) the CELP core module uses, in one sub-frame of a frame of the sound signal, a glottal-impulse-shape codebook, and (b) allocating the second CELP core module part bit-budget comprises (a) initially distributing an equal number of bits from the second CELP core module part bit-budget to the sub-frames of the frame and (b) allocating bits from the second CELP core module part bit-budget remaining after the initial bit distribution to the sub-frame comprising the glottal-impulse-shape codebook; and encode or decode (a) the first CELP core module parts using the respective, first CELP core module parts bit-budgets and (b) the second CELP core module part using the second CELP core module part bit-budget distributed between the sub-frames of the frame.

* * * * *